US007762270B2

(12) United States Patent
De Brouwer et al.

(10) Patent No.: US 7,762,270 B2
(45) Date of Patent: Jul. 27, 2010

(54) INSTRUMENT HAVING WALLS FOR APPLYING A COMPOSITION ON EYELASHES OR EYEBROWS

(75) Inventors: Etienne Andre De Brouwer, Lassigny (FR); Eric Hoisnard, Ognes (FR); Eric Caulier, Malgnelay Montigny (FR)

(73) Assignee: Yves Saint Laurent Parfums, Neuilly sur Seine (FR)

( * ) Notice: Subject to any disclaimer, the term of this patent is extended or adjusted under 35 U.S.C. 154(b) by 0 days.

(21) Appl. No.: 11/534,015

(22) Filed: Sep. 21, 2006

(65) Prior Publication Data

US 2007/0062551 A1 Mar. 22, 2007

(30) Foreign Application Priority Data

Sep. 21, 2005 (FR) ..... 05 09659

(51) Int. Cl.
*A45D 40/26* (2006.01)

(52) U.S. Cl. ..... 132/218

(58) Field of Classification Search ..... 132/218, 132/216, 317, 318, 320, 901, 270, 161; 401/126, 401/129

See application file for complete search history.

(56) References Cited

U.S. PATENT DOCUMENTS 748,420 A * 12/1903 Richardson ..... 132/157
4,635,659 A * 1/1987 Spatz ..... 132/218
4,744,377 A 5/1988 Dolan, Jr.
6,581,610 B1 6/2003 Gueret
6,616,366 B1 * 9/2003 Weihrauch ..... 401/286
7,156,102 B2 * 1/2007 Ramet ..... 132/160
2001/0037815 A1 * 11/2001 Gueret ..... 132/218
2003/0213498 A1 11/2003 Gueret
2004/0161285 A1 * 8/2004 Gueret ..... 401/130
2005/0034740 A1 * 2/2005 Eckers et al. ..... 132/218
2007/0033760 A1 * 2/2007 Dumler ..... 15/187

* cited by examiner

*Primary Examiner*—Cris L Rodriguez
*Assistant Examiner*—Rachel R Steitz
(74) *Attorney, Agent, or Firm*—Jason A. Bernstein; Barnes & Thornburg LLP

(57) ABSTRACT

An instrument for applying a liquid or semi-liquid composition on the eyelashes or the eyebrows, having a core together with an applicator designed to collect the composition and to apply it on the eyelashes or the eyebrows, the applicator projecting from the core between respective bases and tips, wherein the applicator is arranged to form at least one hollow itself defining at least one applicator volume shaped firstly to contain the composition and secondly to enable at least one eyelash or eyebrow hair to pass therethrough in order to be coated in composition, the applicator volume extending from the tip towards the core along a fraction only of the length of the applicator, the applicator volume being defined by at least first and second substantially solid walls disposed facing each other, each of the first and second walls presenting a nature that is substantially two-dimensional.

26 Claims, 4 Drawing Sheets

A-A

INSTRUMENT HAVING WALLS FOR APPLYING A COMPOSITION ON EYELASHES OR EYEBROWS

PRIORITY CLAIM

This patent application claims priority to French Patent Application No. FR-05 09659, filed Sep. 21, 2005, the disclosure of which is incorporated herein by reference in its entirety.

FIELD OF THE INVENTION

The present invention relates to devices for applying compositions, in particular cosmetic compositions on hairs or nails, and in particular on hairs such as the eyelashes or eyebrow hairs.

The present invention relates to an instrument for applying a liquid or semi-liquid composition on the eyelashes or the eyebrows, the instrument comprising a core and applicator means designed to collect said composition and to apply it on the eyelashes or eyebrows, said applicator means projecting from the core between a base and a tip.

In its preferred exemplary application, the instrument in accordance with the invention constitutes a mascara applicator for the eyelashes, for taking a quantity of mascara from a receptacle and for transporting said quantity to the eyelashes in order to deposit it thereon.

BACKGROUND OF THE INVENTION

Mascara applicators are already known that are in the form of brushes. Conventionally, such brushes comprise a handle member that can also act as a stopper for a receptacle containing the mascara for application, together with a stem extending from the handle member between a proximal and a distal end.

A multitude of bristles project radially from the stem, at the distal end thereof, thus forming an applicator head.

Such prior art brushes are designed to be used as follows.

The user dips said brush in the receptacle containing mascara, thereby partially coating the bristles and the stem in mascara. The user then performs a brushing action on the eyelashes using the brush, thereby transferring mascara from the brush towards and onto the eyelashes.

Such known mascara brushes nevertheless present a certain number of drawbacks.

Firstly, prior art brushes generally do not make it possible to control the quantity of mascara they collect from inside the receptacle.

In some cases, the brush thus does not enable a sufficient quantity of mascara to be collected, such that the user must keep on dipping the brush into the receptacle, which can be inconvenient and can lead to risks of the stock of mascara contained in the receptacle becoming polluted or even contaminated. In addition, brushing the eyelashes with a brush that carries insufficient mascara can be particularly disagreeable or even painful because of the friction caused thereby.

In other cases, in particular when the mascara is very viscous or thick, after the brush has been dipped in the supply it can become overfilled with mascara. This means that the brush takes too great a quantity of mascara to the eyelashes in comparison with the eyelash area for covering.

This can lead to poor-quality makeup, when a large fraction of this excess mascara is transferred onto the eyelashes, forming unattractive clumping between and on the eyelashes. Furthermore, given that all of the excess mascara is not transferred in full onto the eyelashes, the unused mascara that has remained on the brush is reinserted into the supply of mascara within the receptacle, thereby increasing the risk of the supply becoming dirtied and contaminated. In addition, this leftover mascara that has remained on the brush tends to dry out on the brush, which in the long run reduces the applicator qualities of the brush and degrades the supply of mascara contained in the receptacle by mixing dry mascara particles in with that supply.

Finally, prior art brushes do indeed enable the eyelashes to be combed while mascara is being applied, but as a general rule the combing function is not sufficient for obtaining continuous, uniform, and smooth coating of the eyelashes.

SUMMARY OF THE INVENTION

Consequently, a feature provided by the invention is to remedy the various drawbacks specified above and to propose a novel instrument for applying a liquid or semi-liquid composition on the eyelashes or the eyebrows that makes it possible both to collect accurately an appropriate quantity of mascara and to apply said mascara in substantially uniform manner on the eyelashes, in a manner that is particularly smooth and while performing movements that are conventional.

Another feature of the invention is to propose a novel instrument for applying a liquid or semi-liquid composition on the eyelashes or the eyebrows, the instrument being of structure that is particularly simple and inexpensive.

Another feature of the invention is to propose a novel instrument for applying a liquid or semi-liquid composition on the eyelashes or the eyebrows that enables the eyelashes or eyebrows to be combed effectively.

Another feature of the invention is to propose a novel instrument for applying a liquid or semi-liquid composition on the eyelashes or the eyebrows that provides a sensation of contact with the eyelashes or eyebrows that is particularly smooth and flexible.

Another feature of the invention is to propose a novel instrument for applying a liquid or semi-liquid composition on the eyelashes or the eyebrows in which the zone that is to come into contact with said eyelashes or eyebrows is particularly flexible and supple.

Another feature of the invention is to propose a novel instrument for applying a liquid or semi-liquid composition on the eyelashes or the eyebrows which, while being very simple in structure, makes it possible to control accurately the quantity of mascara that is collected and to separate, lengthen, and curve the eyelashes in improved manner.

Another feature of the invention is to propose a novel instrument for applying a liquid or semi-liquid composition on the eyelashes or the eyebrows which enables the eyelashes to be coated substantially uniformly by the composition.

Another feature of the invention is to propose a novel instrument for applying a liquid or semi-liquid composition on the eyelashes or the eyebrows that is of general appearance that is comparable to that of conventional instruments of the prior art, so that the user knows intuitively how to use it.

The features provided by the invention are achieved with the help of an instrument for applying a liquid or semi-liquid composition on the eyelashes or the eyebrows, the instrument comprising a core together with applicator means designed to collect said composition and to apply it on the eyelashes or the eyebrows, said applicator means projecting from the core between respective bases and tips, wherein the applicator means are arranged to form at least one hollow itself defining at least one applicator volume shaped firstly to contain the composition and secondly to enable at least one eyelash or eyebrow hair to pass therethrough in order to be coated in composition, said applicator volume extending from the tip towards the core along a fraction only of the length of the applicator means, said applicator volume being defined by at least first and second substantially solid walls disposed facing each other, each of said first and second walls presenting a nature that is substantially two-dimensional.

BRIEF DESCRIPTION OF THE DRAWINGS

Other advantages and features of the invention appear in greater detail on reading the following description and from the accompanying drawings provided in purely explanatory and non-limiting manner, in which.

DESCRIPTION OF THE INVENTION

Figure 1:
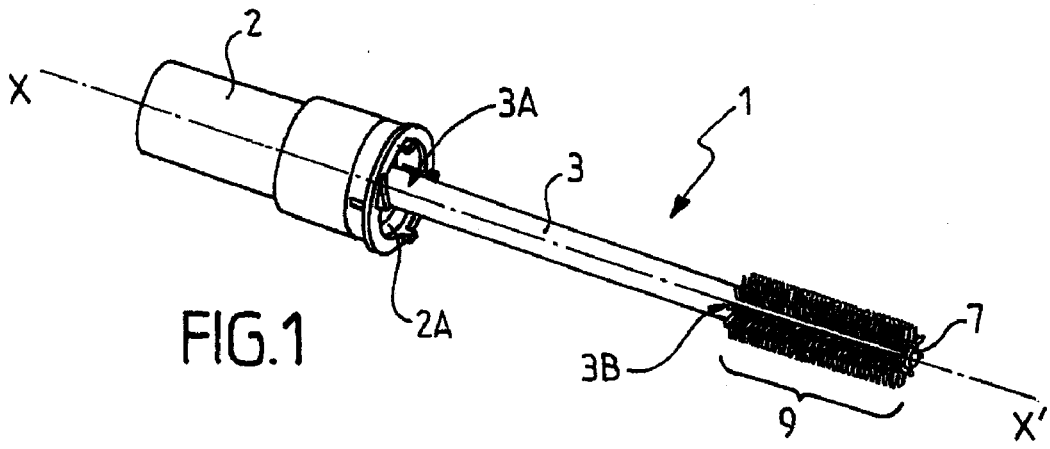
FIG. 1 is a general perspective view of a first embodiment of an instrument in accordance with the invention.
Figure 2:
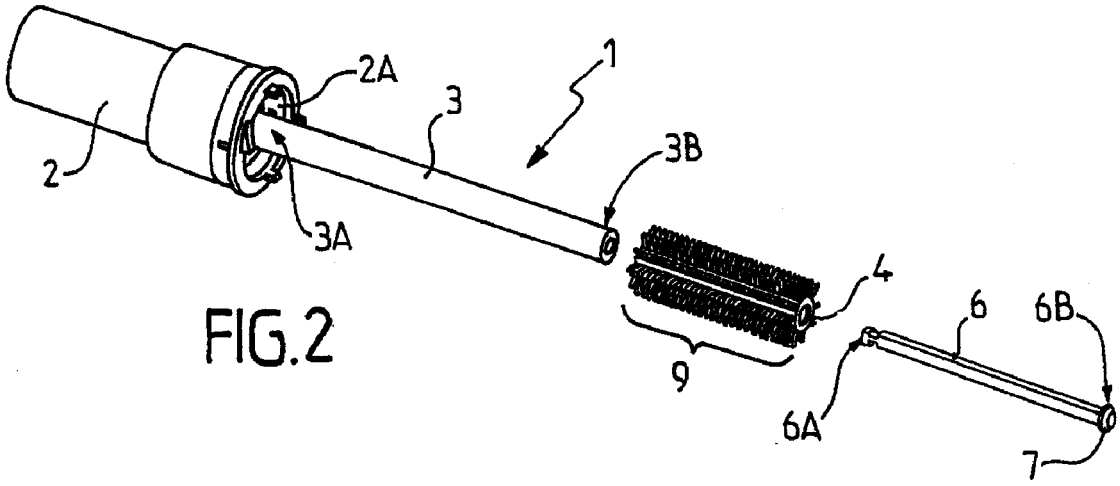
FIG. 2 is an exploded view showing the general principle whereby the instrument shown in FIG. 1 is constructed.
Figure 3:
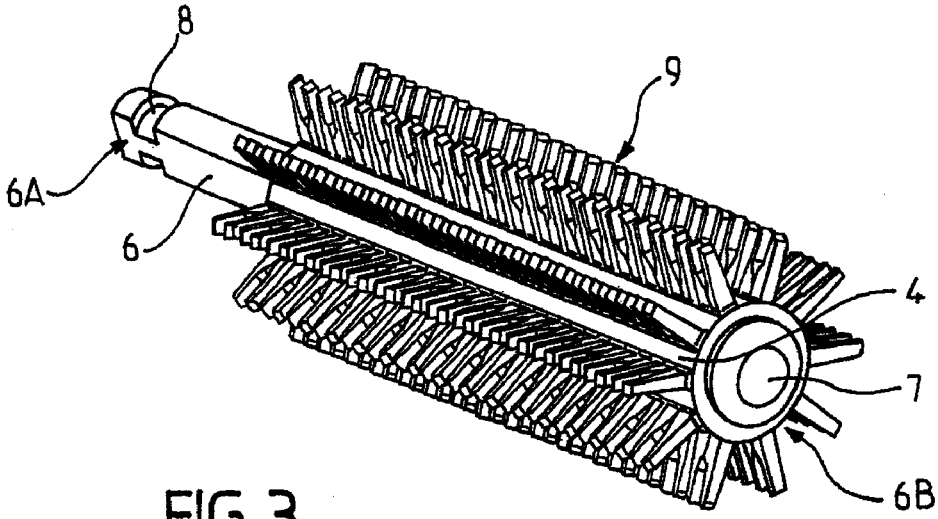
FIG. 3 is another perspective view showing an implementation detail of the instrument shown in FIGS. 1 and 2.

FIGS. 1 and 2 show an instrument 1 in accordance with the invention for applying a liquid or semi-liquid composition on the eyelashes or the eyebrows, the instrument being shown respectively in an assembled state and a disassembled state.

Advantageously, the composition for application is a cosmetic, such that the instrument 1 then constitutes a cosmetic instrument.

Preferably, the composition for application is mascara for the eyelashes, with the instrument 1 then constituting an instrument for applying mascara to the eyelashes.

In order to simplify the description, reference is made below solely to such a mascara applicator. Nevertheless, the invention is not limiting to applying a composition that is exclusively cosmetic in nature, nor to applying a composition that necessarily presents properties identical to those of a mascara. Thus, the instrument 1 may optionally be used for applying any composition that is liquid or semi-liquid, regardless of its consistency, which composition may optionally be very fluid, or conversely may present the characteristic of being very viscous and pasty.

In known manner, the instrument 1 comprises a handle member 2 designed to be held and manipulated in the hand of a user, e.g., between two or three fingers. In conventional manner, the instrument 1 thus presents the characteristic of being portable and it is intended to be used in the hand.

Preferably, the handle member 2 also serves as a stopper for a receptacle (not shown) containing a supply of the composition for application, which composition is preferably mascara for the eyelashes. To this end, the handle member 2 may be provided with tapping 2A designed to co-operate with a complementary thread (not shown) extending around the opening of the receptacle that is to be closed. Such an arrangement is conventional, and is therefore not described in greater detail below.

Advantageously, the instrument 1 includes a stem 3 extending in substantially rectilinear manner from the handle member 2 between a proximal end 3A and a distal end 3B.

In accordance with the invention, the instrument 1 includes a core 4 which is preferably located towards the distal end 3B of the stem 3.

The core 4 advantageously extends in an axial direction X-X', preferably in substantially rectilinear manner from the distal end 3B and in line with the stem 3. In the example shown in the figures, the core 4 is separate from the stem 3.

Nevertheless, it is entirely possible to envisage the core 4 being formed directly by the stem 3 itself.

It is also possible to envisage the core 4 extending in a manner that is not strictly rectilinear, as shown in the figures, but for example presenting a shape that curves slightly (not shown), and that is complementary to the profile presented by the eyelashes. Under such circumstances, the axial direction X-X' is clearly not defined by a straight line, but by a curved line that follows the outline along which the core 4 extends.

The core 4 is preferably elongate and slender in shape. In other words, the core 4 is advantageously long and thin in shape, i.e. extending for the most part in a single direction in three dimensions. In this respect the core 4 can be thought of as being one-dimensional.

Preferably, and as shown in FIGS. 1-3 and 10, the core 4 is in the form of a single piece.

Nevertheless, and as shown in FIGS. 4-9, it is also possible to envisage the core 4 being made up of at least two distinct individual pieces 4A, 4B, 4C, and 4D that are independent, being disposed end to end continuously and in line with one another.

Figure 4:
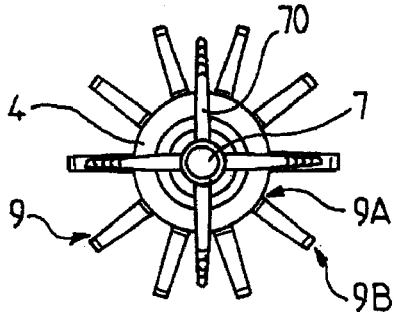
FIG. 4 is an end view showing an implementation detail of an instrument in accordance with a second exemplary embodiment.
Figure 5:
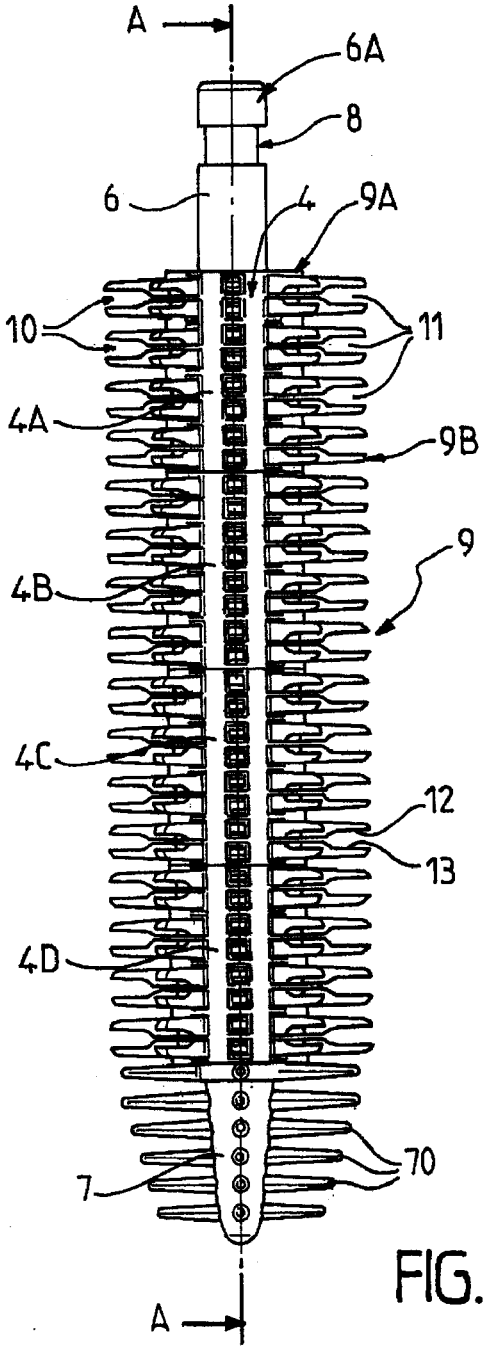
FIG. 5 is a plan view showing the implementation detail shown in FIG. 4.
Figure 6:
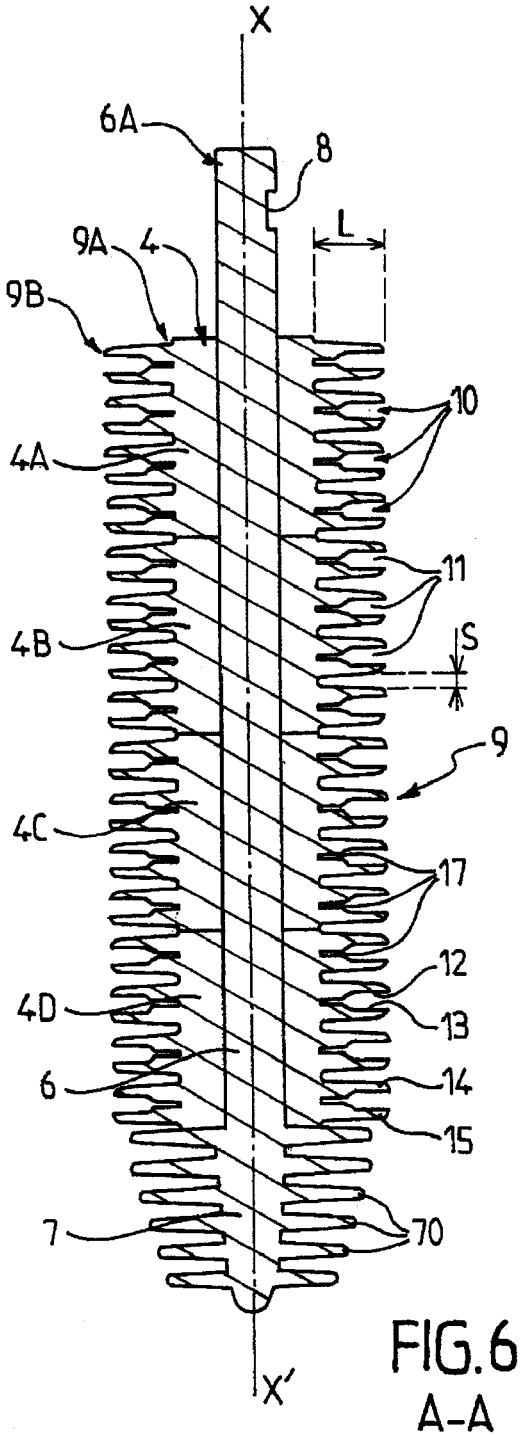
FIG. 6 is a side view in section on line A-A showing the detail of the instrument shown in FIG. 5.

In the exemplary embodiment of FIGS. 4-6, the core 4 is thus made up of a stack of four distinct individual pieces 4A, 4B, 4C, and 4D.

In an embodiment that is particularly advantageous and that is shown in the figures, the core 4 is in the form of a single piece (cf. FIGS. 1-3) or a plurality of pieces (cf. FIGS. 5-9), each piece being long and slender and pierced along its entire length by a through hole 5. The core 4 is preferably substantially cylindrical in shape, preferably on a base that is circular, with the hole 5 being formed in its center.

In this variant, the core 4 forms a sheath that is to be threaded onto a pin 6 extending between a first end 6A and a second end 6B. The sheath forming the core 4 is designed to be threaded onto the pin 6 via the first end 6A, with the second end 6B being provided with abutment means 7 against which the sheath is designed to bear. In the embodiment shown in FIGS. 1-3, the abutment means 7 may be constituted merely by a disk formed integrally with the shank of the pin 6 and of diameter greater than the diameter of the hole 5. In the exemplary embodiment of FIGS. 4-6, the abutment means 7 is more elaborate and is constituted by a converging head, e.g. of conical shape, provided with projections 70 that are designed to make it easier to apply makeup to the corner of the eye.

The other end 6A of the pin 6 is advantageously provided with means for fastening to the distal end 3B of the stem 3. By way of example, and as shown in the figures, the first end 6A may include a groove 8, with the first end 6A being designed to be inserted into an orifice formed axially in the stem 3. Final assembly is then implemented by crimping the stem onto the pin 6, where said crimping is obtained by deforming the material constituting the stem 3 centripetally into the groove 8.

In accordance with the invention, the instrument 1 includes applicator means 9 designed to collect the composition and to apply it onto the eyelashes (or the eyebrows). The applicator means 9 are thus specifically designed to pick up the composition for application, e.g. by being immersed in a supply thereof, and to retain and contain said quantity of the composition that has been picked up until it is released on the eyelashes, with release preferably being performed by putting the applicator means 9 into contact with the eyelashes and rubbing thereagainst.

In accordance with the invention, each applicator means 9 projects from the core 4 between a base 9A and a tip 9B. In other words, each applicator means 9 is preeminent relative to the core 4, forming a projection from said core 4. Preferably, each applicator means 9 extends radially relative to the axis of symmetry X-X' of the core 4.

According to an important characteristic of the invention, each applicator means 9 is arranged to form at least one hollow 10, itself defining at least one applicator volume 11 shaped firstly to contain the composition for application, and secondly to enable at least one eyelash (or eyebrow) to pass therethrough in order to be coated in composition.

In other words, the shape of each applicator means 9 enables at least one cavity to be formed that has at least one receptacle-forming portion corresponding to the applicator volume 11 that serves to collect, contain, and retain the composition for application.

In particular, the applicator volume 11 preferably forms a vesicle which, when dipped in a supply of liquid composition for application, becomes filled with said composition, and retains the composition within itself by capillarity and/or a surface tension mechanism.

Each hollow 10 and associated applicator volume 11 are thus shaped and sized specifically with reference to the physico-chemical characteristics of the composition for application, and in particular its viscosity and its consistency, so that each applicator volume 11 is effective in retaining a predetermined quantity of composition within itself, regardless of the orientation of the volume 11 in three dimensions.

In order to enable at least one eyelash to pass through in order to be coated with composition, each applicator volume 11 presents at least one dimension that is greater than the size (diameter) of an eyelash (or an eyebrow hair).

Preferably, and as shown in the figures, each applicator volume 11 is open to the outside so as to enable eyelashes to penetrate therein while the eyelashes are being subjected to a brushing action by the instrument 1.

According to the invention the applicator volume 11 extends from the tip 9B towards the core 4 (and thus towards the base 9A) over only a fraction D of the length L of the applicator means 9. In other words, each applicator volume 11 is located towards the tip 9B of the applicator means 9 and extends at a distance away from the core 4, each applicator volume 11 being spaced apart from said core 4 by a distance d.

By way of example, the fraction D can represent 1% to 99% of the length L, and preferably lies in the range 20% to 75%, and even more preferably in the range 50% to 70%, with values of about 55%, 60%, or indeed 65% giving advantageous results.

By means of this technical characteristic, the composition for application is concentrated towards the radial periphery of the instrument 1 and does not accumulate uselessly against the core 4 towards the base of the applicator means 9.

This makes it possible to concentrate the composition in a zone where it is highly probable that it will come into contact with an eyelash, and thus avoid loading the brush with a useless quantity of composition in a zone that is difficult for eyelashes to reach.

The invention thus relies in particular on the idea of effectively retaining a predetermined quantity of composition for application at the periphery of the instrument 1, while avoiding useless accumulation of the composition towards the base 9A, i.e. in a zone that is not designed to interact directly with eyelashes.

Specifically for the purpose of obtaining better control over the quantity of composition that is collected by the applicator means 9 and retained in each applicator volume 11, and in order in particular to avoid transferring composition out from the applicator volumes 11 towards zones of the instrument 1 that are not designed to interact directly with the eyelashes, each applicator volume 11 is defined by at least first and second substantially solid walls 12 and 13 that are disposed facing each other.

The term "substantially solid" is used herein to mean that each of the walls is formed in a piece of material that is substantially continuous, in contrast in particular to walls formed by uniting discrete elements, in particular by uniting fibers or bristles placed one beside another. In other words, each wall 12, 13 is substantially unitary in nature, and also continuous or one-piece.

As mentioned above, the solid walls 12 and 13 face each other, i.e. they are parallel and face to face in register with each other.

The typical characteristics described above provide improved control over substance retention by the applicator means 9 by encouraging predetermined and controlled quantities of composition to be confined in zones that are precisely located. The two facing walls 12 and 13 also form a channel for passing at least one eyelash, thereby encouraging smoothing and coating of the eyelash by the composition. For this purpose, each of the two walls 12, 13 preferably extends along a (preferably plane) surface that is substantially perpendicular to the axial direction X-X', as shown in the figures.

Advantageously, the applicator means 9 are formed integrally with the core 4. In other words, in this advantageous configuration that is implemented by all of the variant embodiments shown in the figures, the applicator means 9 and the core 4 together form a single unitary subassembly.

Preferably, the core 4 and the applicator means 9 are obtained in a single operation of injection-molding a plastics material, preferably an elastomer or a polymer of the polytetrafluoroethylene (PTFE) type. The invention thus lends itself particularly well to manufacture by injection-molding plastics materials, which is fast and inexpensive. Naturally, the invention is not limited to an instrument 1 implementing applicator means 9 formed integrally with the core 4. The applicator means 9 may be distinct from the core 4, and may be secured thereto by any appropriate means, e.g. by adhesive, heat-sealing, or mechanical assembly.

In an alternative embodiment (not shown), it is also possible to envisage the core 4 being made not with a central orifice 5, but being made directly with a portion of pin that projects from one of its ends in order to interact with a corresponding hole formed in the distal portion 3B of the stem 3. In this advantageous variant, the applicator means 9, the core 4, and the portion of pin 6 are made simultaneously in a single injection-molding operation.

Advantageously, the applicator means 9 includes at least two projections 14, 15 disposed facing each other and spaced apart by an interstitial gap forming the hollow 10, and thus the applicator volume 11.

Preferably, and as shown in the figures, the applicator means 9 comprises a plurality of projections 14, 15 co-operating in pairs so that each pair defines a corresponding applicator volume 11.

Figure 13:
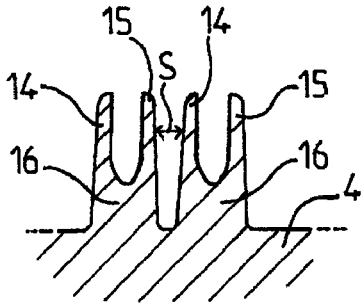
FIG. 13 is a diagrammatic side view in section showing an implementation detail of a fifth exemplary embodiment of the invention.

In the exemplary embodiment shown in FIG. 13, the two projections 14, 15 project from a common root 16 which, on going from the base 9A towards the tip 9B, becomes subdivided into two arms that form the two respective projections 14, 15.

In the other embodiments shown in FIGS. 1-12, constituting preferred embodiments, the two projections 14, 15 extend independently of each other from the core 4, i.e., they are substantially completely separate over their entire length. This technical characteristic serves to improve the individual flexibility characteristics of each projection 14, 15 which in turn improves comfort while applying makeup by encouraging flexible contact between the instrument 1 and the eyelashes, and enabling the eyelashes to be combed effectively. This preferred variant thus provides an excellent compromise between quantitative and positional control over the quantity of composition that is picked up and retained by the instrument 1, and also the ability of the instrument to perform combing.

Advantageously, the interstitial gap between the two projections 14, 15 comprises first and second segments of respective lengths D and d, joined together by a connection zone, the first segment extending from the tip 9B to the connection zone and corresponding to the applicator volume 11, while the second segment extends from the connection zone to the core 4 and forms a clearance space 17 for making it easier to bend each projection 14, 15 near the base 9A.

Thus, in this preferred embodiment, the interstitial gap presents along each projection and between the projections a shape that serves to define firstly the applicator volume 11, and secondly the clearance space 17. In preferred manner, and as shown in the figures, the spacing E between the two projections 14, 15 level with the first segment (of length D) is greater than the spacing e between the two projections 14, 15 level with the second segment. Under such circumstances, the connection zone between the two segments may be convergent in shape, as shown in the figures. The convergence may be symmetrical (FIGS. 1-11) or asymmetrical, as in the variant of FIG. 12. It is also possible to envisage that the transfer from the spacing E to the spacing e is not progressive, but on the contrary takes place suddenly in a single step.

The spacing E is dimensioned in particular as a function of the intrinsic characteristics of the composition for application so as to enable said composition to be retained between the projections 14, 15 while allowing at least one eyelash to pass between them. The spacing e is dimensioned so as to allow each of the projections 14, 15 to bend individually towards and in the vicinity of the base 9A, while limiting at much as possible the quantity of composition that is liable to be found in the second segment. In preferred manner, the spacing e is selected so as to be small enough compared with the physicochemical properties of the composition for application (in particular in viscosity as surface tension) to prevent the composition from penetrating into the second segment of length d.

The spacing e may also be selected so as to be optionally smaller than the diameter of an eyelash, so as to prevent an eyelash from penetrating into the second segment.

As an indication, the spacing E may lie in the range about 0.2 millimeters (mm) to 1 mm, and more preferably in the range 0.3 mm to 0.7 mm, with preferred values lying in the range 0.4 mm to 0.5 mm, the limits of this preferred range giving excellent results.

As for the spacing e, it preferably lies in the range 0.05 mm to 0.5 mm, with the preferred value being substantially about 0.1 mm. In particularly advantageously manner, the spacing E is equal to 0.4 mm or 0.5 mm, while the spacing e is substantially equal to 0.1 mm.

Advantageously, each projection 14, 15 is formed by a flexible blade, preferably made of an elastomer material or of a polymer material such as PTFE. Each blade preferably performs two functions, since it contributes firstly to forming the hollow 10, in association with at least one other blade, and secondly it forms a "tooth" suitable for combing the eyelashes. As shown in the figures, each blade is preferably long and thin in shape, with a cross-section that is substantially rectangular, and it extends substantially radially from the core 4 relative to the axis X-X'. The blades are grouped in pairs and placed in rows, preferably along the axial direction X-X' in a manner that is regularly spaced apart on the periphery on the core 4.

In preferred manner, the pairs are mutually spaced apart by spacing S that is large enough to limit any retention of composition for application between the pairs. In this way, the composition is preferably concentrated within the applicator volumes 11 provided for this purpose.

Figure 7:
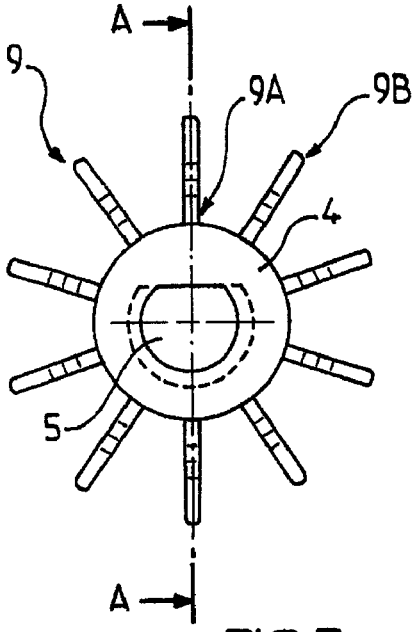
FIG. 7 is an end view showing an implementation detail of an instrument in accordance with a third exemplary embodiment of the invention.
Figure 8:
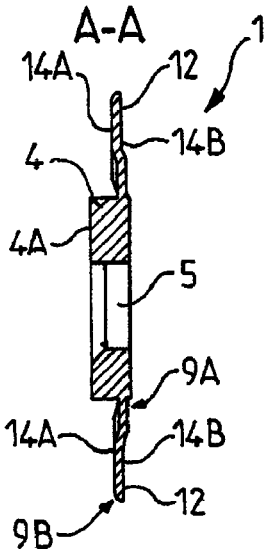
FIG. 8 is a diagrammatic side view in section showing the detail of FIG. 7.
Figure 9:
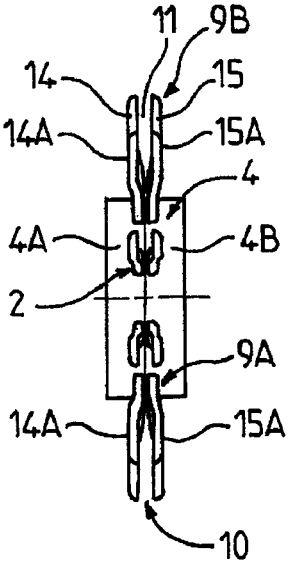
FIG. 9 is a diagrammatic side view showing how the third exemplary embodiment of the invention is made.
Figure 10:
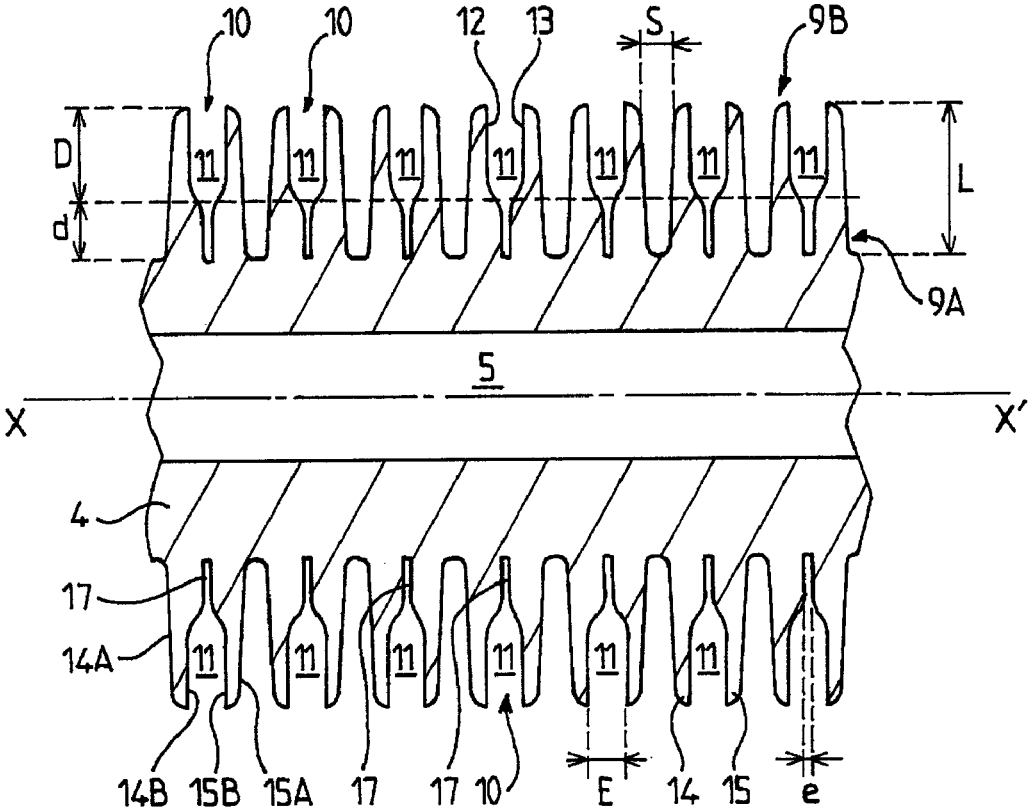
FIG. 10 is a diagrammatic side view in section showing an implementation detail of the instrument shown in FIGS. 1-3.

In the variant of FIGS. 4-6, each element 4A, 4B, 4C, and 4D carries a series of rows of pairs of blades, with each pair defining an applicator volume 11. In the variant of FIGS. 7-9, the applicator means 9 are constituted by a stack of a plurality of washers 4A, 4B forming the core 4, each washer 4A, 4B carrying a ring of first blades 14 for co-operating with a ring of second blades 15 carried by a second washer so as to form the applicator volumes 11.

As shown in the figures, each projection 14, 15 presents an outside face 14A, 15A and an opposite, inside face 14B, 15B, said inside faces 14B, 15B being disposed facing each other and contributing respectively to forming the first and second walls 12, 13.

Figure 11:
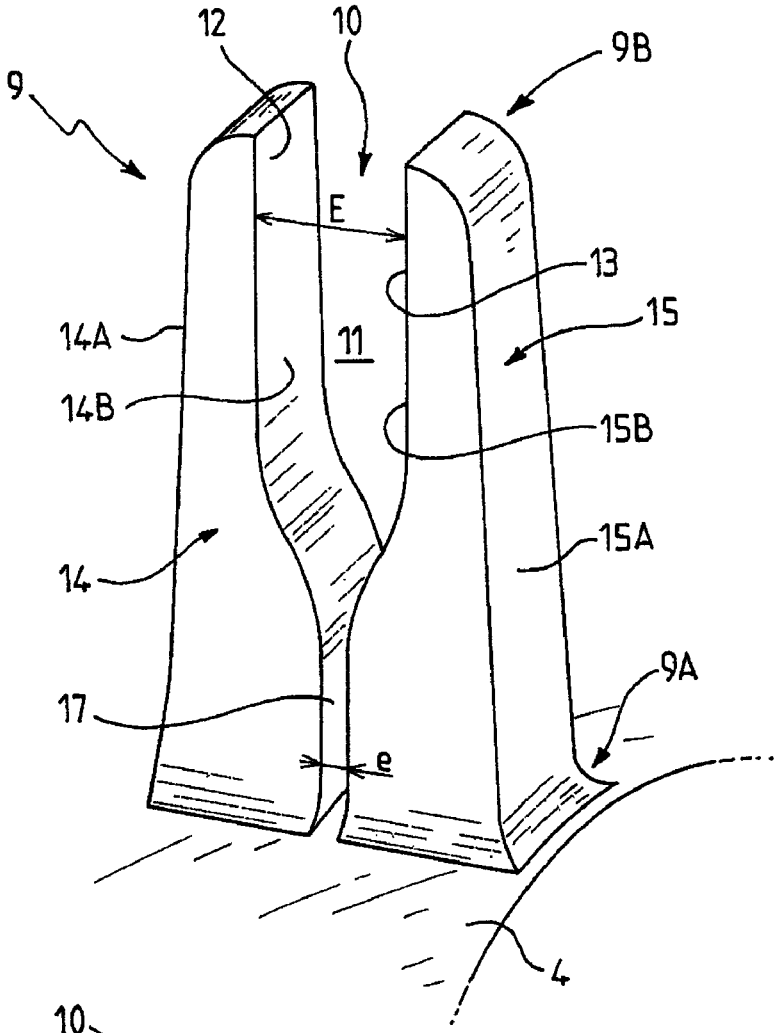
FIG. 11 is a diagrammatic perspective view showing an implementation detail common to the embodiments shown in FIGS. 1-10.
Figure 12:
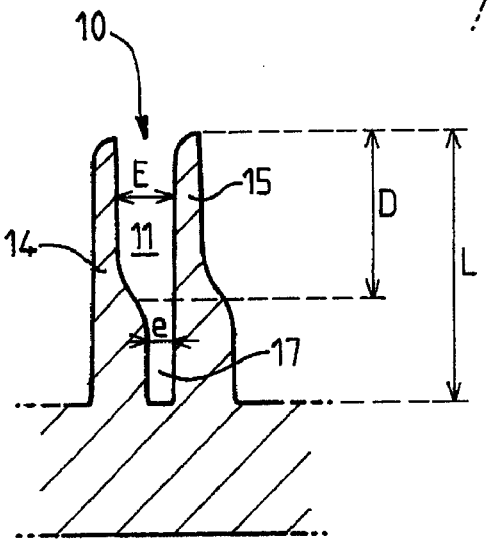
FIG. 12 is a diagrammatic side view in section showing an implementation detail of a fourth exemplary embodiment of the invention.

Advantageously, each of said first and second walls 12, 13 is substantially two-dimensional in character, i.e., as can be seen particularly in FIG. 11, extending in two directions in three-dimensional space with respective orders of magnitude that are comparable. This technical measure is preferred since it enables the composition to be retained in improved manner between the blades, and it also serves to improve the effect whereby an eyelash is coated in the composition on being engaged in the applicator volume 11, with the applicator volume then being moved along the eyelash under the effect of the brushing movement performed by the user.

Nevertheless, without going beyond the ambit of the invention, it is also possible to envisage the first and/or second walls 12, 13 being substantially one-dimensional, i.e. extending for the most part in linear manner in only one direction in three-dimensional space. This can apply, for example, for a blade (not shown) that is substantially cylindrical or tapering in shape and that presents a section that is not like the substantially rectangular section of the blades shown in the figures.

The first and second walls 12 and 13 are preferably parallel and advantageously extend substantially perpendicularly to the axial direction X-X'. In particularly preferred manner, each of said first and second walls 12, 13 presents at least one substantially plane surface, said plane surfaces being advantageously disposed substantially parallel to each other, as shown in the figures.

By encouraging the creation of a sheet of composition between the blades, this technical measure serves to further improve the effects of composition retention and of eyelash smoothing and/or coating, as mentioned above.

These effects are further improved with first and second walls 12 and 13 each presenting surfaces that are substantially smooth and regular, preferably free from any geometrical irregularities or roughness.

Naturally, the invention is not limited to implementing an applicator volume 11 that is defined solely by two plane faces, it being possible for the applicator volume to be defined by faces that present any other geometrical outline, e.g., presenting a plurality of plane facets, or indeed an outline that is substantially curved.

As shown in the figures, the applicator volume 11 is preferably defined exclusively by two parallel faces 14B, 15B, with the volume 11 thus forming a kind of notch at the surface of the applicator means 9, said notch extending in a plane that is substantially perpendicular to the axial direction X-X' and being suitable firstly for retaining the composition and secondly for receiving an eyelash while applying the composition.

In other words, each applicator volume 11 thus defines a channel opening out to the tip 9B of the applicator means 9 and extending between two openings in a direction that is substantially perpendicular to the axial direction X-X'.

Naturally, the blades may be disposed in angular orientations that are different from those shown in the figures without thereby going beyond the ambit of the invention. For example, each pair of blades could be disposed obliquely relative to the axial direction X-X'. Alternatively, or in combination, the blades could also extend not radially, but in a direction that is oblique relative to the radial direction.

The invention operates as follows.

The user grasps the handle member 2 in the hand while it is screwed on a mascara receptacle (not shown).

After unscrewing the member 2, the user pulls on the instrument 1 in order to extract the applicator means 9 from the supply of mascara in which it was immersed.

After passing through a wiper, e.g., constituted by an orifice of section that is small compared with the radial size of the applicator means 9, the applicator means 9 reaches the open air where it is ready for being put into contact with the eyelashes. In each applicator volume 11 formed by the blades of the instrument 1, there is to be found a controlled and predetermined quantity of mascara.

The space between each pair of blades defining an applicator volume 11 is preferably designed to limit mascara retention as much as possible and to encourage removal of mascara. The mascara is thus preferably contained for the most part in each of the applicator volumes 11.

The user then exerts a combing action on the eyelashes by using the applicator means 9, with the axis of symmetry X-X' of the instrument 1 being substantially perpendicular to the direction in which the eyelashes extend during the combing action.

While combing is taking place, the eyelashes penetrate, preferably individually, into the applicator volumes 11, thus taking up mascara. Because of the presence of walls 12, 13 that are solid, each eyelash is individually coated and smoothed by the composition contained in the applicator volume 11.

Each flexible blade also contributes to ensuring that the eyelashes are well separated from one another.

To sum up, it has been found that the instrument 1 in accordance with the invention makes it possible to perform the following four functions in an improved manner: separating the eyelashes; lengthening the eyelashes; curving the eyelashes; and coating the eyelashes in mascara in order to obtain a "volume" effect.

For this purpose, the dimensions of each applicator volume 11 in the axial direction X-X', and the spacing S between said applicator volumes are selected as a function of the physiological spacing between eyelashes so as to make it possible preferably and as much as possible to engage eyelashes individually in respective applicator volumes 11.

The invention claimed is:

1. An instrument for applying a liquid or semi-liquid composition on the eyelashes or the eyebrows, said instrument comprising:

a) a core;

b) an applicator projecting from and disposed at least partially around said core between respective bases and tips, wherein said applicator is arranged to form at least one hollow opening defining at least one applicator volume shaped to contain said composition and to enable at least one eyelash or eyebrow hair to pass through at least a portion of said applicator volume in order to be coated in composition;

c) said applicator volume extending from the tip of said applicator means towards said core along a portion of the length of said applicator means but said portion not extending to said core, said applicator volume being defined by at least one set of first and second substantially solid, flat walls of said applicator means disposed generally parallel to and facing each other.

2. The instrument of claim 1, wherein the applicator is made integrally with the core.

3. The instrument of claim 1, wherein the applicator comprises at least two projections placed facing each other and spaced apart by an interstitial gap forming said hollow opening.

4. The instrument of claim 3, wherein each of said two projections extending independently from each other and independently from the core, the space between said two projections defining an interstitial gap.

5. The instrument of claim 4, wherein the interstitial gap comprises first and second gap segments joined by a connection zone gap, the first segment gap extending from the tip to the connection zone gap and corresponding to the applicator volume, while the second segment gap extends from the connection zone gap to the core and forms a clearance space to facilitate bending of each projection towards the base.

6. The instrument of claim 5, wherein each of the first and second segments presents a cross-section that is substantially constant.

7. The instrument of claim 6, wherein the spacing between said two projections level with the first segment is greater than the spacing between said two projections level with the second segment.

8. The instrument of claim 3, wherein each projection is formed by a flexible blade.

9. The instrument of claim 3, wherein the applicator comprises a plurality of projections cooperating in pairs so that each pair defines a corresponding applicator volume.

10. The instrument of claim 1, wherein each of the first and second walls presents a surface that is substantially smooth and regular.

11. The instrument of claim 1, wherein each of the first and second walls presents at least one surface that is substantially planar.

12. The instrument of claim 11, wherein said planar surfaces are disposed substantially parallel to each other.

13. The apparatus of claim 1, wherein said first and second walls have a proximal end proximate to said core and a distal end distal from said core, the width of the gap between said first and second walls at said proximal end is narrower than the gap at said distal end, there being no appreciable widening of said gap from distal to the portion of said proximal end associated with said core.

14. The apparatus of claim 1, wherein said applicator projects substantially radially from said core.

15. The apparatus of claim 1, wherein said applicator is disposed in at least two distinct rows, namely a first and a second row, an applicator of said first row having a free end pointing toward a first direction while an applicator of said second row has a free end pointing toward a second direction which is different from said first direction.

16. The apparatus of claim 1, wherein the dimensions of the applicator cross-section vary.

17. The apparatus of claim 1, wherein the bases of said applicator is thicker than the tips of said applicator.

18. An instrument for applying a liquid or semi-liquid composition on eyelashes or eyebrows, the instrument comprising:

a) a core comprising a stem;

b) an applicator associated with said stem and disposed at least partially around said core for collecting said composition and applying said composition on the eyelashes or the eyebrows, said applicator comprising i) at least one row of a plurality of spaced apart projections projecting from said stem, ii) each projection comprising a pair of opposing first and second fingers defining a gap therebetween, iii) each finger having an inner surface and an outer surface, said inner surface comprising a first section being generally orthogonal to said stem, a second section angled with respect to said first section, a third section being generally orthogonal to said stem and also generally co-parallel with said first section, said first finger and second finger first segment inner surfaces being generally flat, opposed to and substantially parallel each other and defining a first gap section therebetween, at least one of said first and said second finger second section inner surfaces being angled toward the other and defining a second gap section therebetween, and said first and said second finger third section inner surfaces being substantially parallel to each other and defining a third gap section therebetween, said first and second gap sections defining a volume capable of retaining said composition, whereby said first gap section is wider than said third gap section, such that only a portion of said gap can retain a volume of said composition, and such that said gap is sized to permit at least one eyelash or eyebrow hair to pass through said gap so as to be at least partially coated with said composition.

19. The instrument of claim 18, wherein said composition is retained substantially within at least a portion of said first and second gap sections.

20. The instrument of claim 18, wherein at least one hair can pass through said first and said second gap sections but not said third gap section.

21. The apparatus of claim 18, wherein said first section is narrower than said third section.

22. An instrument for applying a liquid or semi-liquid composition on the eyelashes or the eyebrows, the instrument comprising:

a) a core comprising a stem;

b) an applicator associated with said stem and disposed at least partially around said core for collecting said composition and applying said composition on the eyelashes or the eyebrows, said applicator comprising i) at least one row of a plurality of spaced apart projections projecting from said stem, ii) each projection comprising a pair of opposing first and second fingers defining a gap therebetween and a base portion associated with said stem, iii) each finger having an inner surface and an outer surface, said inner surface comprising a first section being generally orthogonal to said stem, a second section angled with respect to said first section, said first finger and second linger first segment inner surfaces being generally flat, opposed to and substantially parallel to each other and defining a first gap section therebetween, at least one of said first and said second finger second section inner surfaces being angled toward the other and defining a second gap section therebetween, said first and second gap sections defining a volume capable of retaining said composition, such that said gap is sized to permit at least one eyelash or eyebrow hair to pass through said gap so as to be at least partially coated with said composition and whereby adjacent projections are spaced apart to define a spacing therebetween, said spacing being sized to enable said volume to engage individual eyelashes or eyebrow hairs.

23. The apparatus of claim 22, wherein inner surface of said first and second fingers each have a proximal end proximate to and connected with said stem and a distal end distal from said stem, the distance between said distal ends of an adjacent pair of first and second fingers being greater than the distance between said proximal ends.

24. An instrument for applying a liquid or semi-liquid composition on the eyelashes or the eyebrows, said instrument comprising:

a) a core;

b) an applicator disposed at least partially around said core for holding said composition and applying said composition on said eyelashes or said eyebrows, said applicator comprising a first projection and a second projection, each said projection having a base portion associated with said core and a distal tip portion wherein said first and second projections have a degree of flexion with respect to one another and said base;

c) at least one hollow opening formed by said applicator, each said hollow opening being defined by (i) a first opening portion having a first substantially solid generally flat wall of said first projection and a second substantially solid generally flat wall of said second projection, said walls disposed generally parallel to and facing each other, (ii) second opening portion defining an elongated passage narrower in width than said first opening portion and proximate to said base portion, and (iii) a third opening portion disposed between said first and second opening portions, said third opening portion having a tapered section, said first, second and third opening portions being in fluid communication with one another; and, d) an applicator volume comprising said first opening portion and at least a part of said third opening portion but not extending completely through said second opening portion to said core, wherein said at least one hollow opening may hold said composition and enable at least one eyelash or eyebrow hair to pass through at least a portion of said applicator volume in order to be at least partially coated in composition.

25. A mascara applicator apparatus, comprising:

a) an instrument for applying a liquid or semi-liquid composition on the eyelashes or the eyebrows, the instrument comprising i) a core, ii) an applicator for holding said composition and applying said composition on said eyelashes or said eyebrows, said applicator comprising a first projection and a second projection, each said projection having a base portion associated with said core and a distal tip portion wherein said first and second projections have a degree of flexion with respect to one another and said base, iii) at least one hollow opening formed by said applicator, each said hollow opening being defined by (A) a first opening portion having a first substantially solid generally flat wall of said first projection and a second substantially solid generally flat wall of said second projection, said walls disposed generally parallel to and facing each other, (B) a second opening portion formed by said first and second projection, said second opening portion defining an elongated passage narrower in width than said first opening portion and proximate to said base portion, and (C) a third opening portion disposed between said first and second opening portions, said third opening portion having a tapered section, said first, second and third opening portions being in fluid communication with one another, and, iv) an applicator volume comprising said first opening portion and at least a part of said third opening portion but not extending completely through said second opening portion to said core, wherein said at least one hollow opening may hold said composition and enable at least one eyelash or eyebrow hair to pass through at least a portion of said applicator volume in order to be at least partially coated in composition; and, b) a container for holding a quantity of said composition and in which said instrument can be at least partially inserted to access said composition.

26. The apparatus of claim 25, further comprising a quantity of mascara contained in said container.

* * * * *